US005392922A

United States Patent [19]

Chen

[11] Patent Number: 5,392,922

[45] Date of Patent: Feb. 28, 1995

[54] HIGH CAPACITY DRY SEPARATION APPARATUS WITH AIR-HEAVY MEDIUM FLUIDIZED BED

[75] Inventor: Qingru Chen, Xuzhou, China

[73] Assignee: China University of Mining and Technology, Xuzhou, China

[21] Appl. No.: 134,377

[22] Filed: Oct. 12, 1993

[30] Foreign Application Priority Data

Oct. 16, 1992 [CN] China ..... 92111310.2

[51] Int. Cl.[6] ..... B03B 4/00

[52] U.S. Cl. ..... 209/20; 209/474; 209/486; 209/492; 198/728; 198/731

[58] Field of Search ..... 209/466, 467, 470, 485, 209/488, 492, 493, 494, 495, 502, 20, 486; 198/726, 728, 727, 731, 733, 734

[56] References Cited

U.S. PATENT DOCUMENTS

| | | | |
|---|---|---|---|
| 1,944,643 | 1/1934 | Holmes | 209/470 X |
| 3,300,029 | 1/1967 | Jenkins | 198/728 |
| 3,471,016 | 10/1969 | Eveson et al. | 209/470 |
| 4,194,971 | 3/1980 | Beeckmans | 209/467 |
| 4,787,400 | 11/1988 | Tanis | 198/731 |

FOREIGN PATENT DOCUMENTS

| | | | |
|---|---|---|---|
| 28686 | 12/1931 | Australia | 209/470 |
| 87101056A | 12/1987 | China . | |

*Primary Examiner*—D. Glenn Dayoan
*Assistant Examiner*—Tuan N. Nguyen
*Attorney, Agent, or Firm*—Merchant, Gould, Smith, Edell, Welter & Schmidt

[57] ABSTRACT

A high capacity dry separation apparatus with air-heavy medium fluidized bed having a separation chamber (3) with a fluidized bed above an air distributor (4), a scraper conveyer (2) in the separation chamber (3) having a double-scraper structure made up of two columns of scrapers moving side by side, and a sink discharge outlet (8) at one end of the separation chamber. An up-floating materials discharge outlet (11) and a feed inlet (12) are arranged on opposite sides of the separation chamber (3). An inclined inner circulator (7) for heavy medium is provided in the separation chamber and includes an air inlet tube (13), a cone-shaped buffer chamber (14), a sieve layer (15), a multilayer fabric (16) and a sintered metal plate (17).

6 Claims, 3 Drawing Sheets

HIGH CAPACITY DRY SEPARATION APPARATUS WITH AIR-HEAVY MEDIUM FLUIDIZED BED

FIELD OF THE INVENTION

This invention relates to a high capacity dry separation apparatus with air-heavy medium fluidized bed, which adopts fluidization theory to separate solid particles, especially coal.

BACKGROUND OF THE INVENTION

The conventional coal separation is mainly wet processing in which medium is water. The wet processing method causes much water consumption and high investment and serious environmental pollution. In addition, coal separation is difficult with this method in arid areas.

The U.S. Pat. No. 4,194,971 and China Patent No. CN87101056A have disclosed respectively a dry separation apparatus with fluidized bed. The U.S. Pat. No. 4,194,971 is based on the principle of chemical engineering reactor. The particulate material forms a fluidized bed in an elongated, horizontally extending container, and the moveable scrapers are arranged inside the container. The endless motion of the scrapers compels the lighter material floating on the upper portion of the bed to move and to concentrate to one end, while the heavier material to the other end according to the principle of chemical engineering reactor. So the materials are separated. In the separation process the heavy medium fed into the bed is removed from the bed along with the heavier material. The main disadvantages of this kind of apparatus are:

1. The separation apparatus designed according to the principle of chemical engineering reactor can not meet the needs of industrial applications, as the float on the upper bed layer is scrapped out by the scrapers while the sink is removed by flowing on its own, which limits the handling capacity of the apparatus seriously.

2. The material is fed from the top middle of the bed and lighter and heavier material move in counter-current, which greatly reduces the stability of the fluidized bed and separation precision.

3. The apparatus uses scrapers without holes to scrape the float on the upper bed layer, which not only makes the upper portion of the bed disturbed seriously, but also limits the height and the velocity of the scraper. Therefore, the separation precision and the capacity are reduced.

4. The heavy medium is removed and recovered outside the bed, which makes it very difficult to run the apparatus continuously under certain special conditions.

It's known from China Patent No. CN 87101056A "Coal Dry Cleaning Method and Apparatus with Fluidized Bed" that the apparatus which separates materials on their different densities is mainly composed of the output system with anchorchain-scraper, the medium recovering device, the housing of the fluidized bed and the air distributor. The raw coal fed by the feeder stratifies according to the density in the fluidized bed which is formed by mixed air and fine particulate material with a certain uniformly distributed density and then the anchorchain-scrapers immersed in the bed scrape the lighter material i.e. the float and the heavier material i.e. the sink towards the two ends of the bed respectively to realize the separation. In this patent the raw coal and the heavy medium are fed from the top to the middle part of the separation section, which reduces the stability of the middle portion of the fluidized bed, the length of the separation section and the effective period of separation, and the separation precision is also greatly decreased. Anchorchain-scraper output system is immersed entirely in the fluidized bed, which limits the height of the scraper and the handling capacity of the separator. If the moving velocity of scraper exceeds a limit value, the stability and the homogeneity of fluidized bed will be destroyed, which will result in the chaos of the fluidized bed. So the clean coal and the waste rock in the separation section will confuse each other. Therefore the separation precision will be reduced. In addition, in the anchorchain-scraper output system, holeless single chain boards with reinforced ribs are used, which makes coal and waste rock mixed up on the ribs. Linked with ring chains, the scrapers are liable to sink and touch the air distributor, which makes the distributor easily damaged. The factors mentioned above result in the disadvantages of the apparatus such as low separation precision and capacity, etc.

The aim of this invention is to overcome the disadvantages existing in the prior art separation apparatus with the fluidized bed mentioned above and to improve the separation precision and the capacity to meet the needs of industrial applications.

SUMMARY OF THE INVENTION

The aim of the present invention is realized through the following technical scheme:

1. According to Archimedes's theorem, the fed material stratifies according to density in an air-heavy medium fluidized bed, the fluidized material can move from one end of the bed to the other owing to the difference of the pressure. If the feed inlet and the float discharge outlet are provided at the ends of the separation sector on the opposite side of the bed, the disturbance caused by feeding at the middle part of the bed can be avoided. The impelling force arising from the pressure difference of materials in fluidization state and the overflow characteristics of the fluidized material make the up floating materials move from one end to the other along the length of the bed and drains by overflow, which avoids the decrease of bed stability and separation precision caused by the movement of the scrapers in the upper layer of the bed. As a result, the separation section width, the effective separation period and the capacity are increased.

2. In order to overcome the disadvantages existing in the anchorchain-scraper conveyer system, in this invention a laterally disposed sink scraper conveyer is used. Its upper part is exposed above the fluidized bed and does not come into contact with it. Its lower part is immersed at the bottom of the fluidized bed. The scraper conveyer moves in the direction perpendicular to the movement direction of the up-floating materials and scrapes the sink materials at the bottom of the bed to the sink materials discharge outlet to be drained away therefrom.

3. In order to get over the disadvantages of the disturbance to the bed and the decrease of separation precision arising from the movement of the scraper and to make the heavy medium remain in the bed as much as possible, double-scraper structure is adopted in this invention. There is no reinforced rib on the scraper so that the mixing of lighter material with heavier material can be avoided effectively. Besides, holes are defined on the scraper regularly, with which the disturbance to the fluidized bed caused by the scraper and the resistance acting on the scraper can be reduced. Since the scraper moves at the bottom of the bed only, the height and moving velocity of the scraper can be increased. Chain boards and scrapers are fastened with bolts, which avoids the sinking of the scrapers and damage to the air distributor. Moreover, the heavy medium with small diameter can partly pass through the holes of the scraper and thus remain in the bed. In order to improve the capacity of the fluidized bed, an double-scraper conveyer system in which two columns of scrapers move parallelly is used in this invention.

4. In this invention an inner circulator for heavy medium is provided to overcome the problems that a great deal of heavy medium is scraped out of the separator when the sink material is scraped out by the scraper, and that the normal movement of the scraper and the discharging amount of the sink material are limited due to the dead region at the area near the flank of the housing after its moving away the air distributor along with the scraper. The inner circulator makes the heavy medium circulate in the separator. Thus the circulating amount of the medium outside the apparatus is reduced and the stability of the fluidized bed and the capacity of continuous operation are enhanced.

DETAILED DESCRIPTION OF THE PREFERRED EMBODIMENT

In the following the description of the preferred embodiment will be made with reference to the accompanying drawings, in which, FIG. 1 is the diagrammatic front view of the structure of an preferred embodiment of the separation apparatus according to the present invention.

Figure 1:
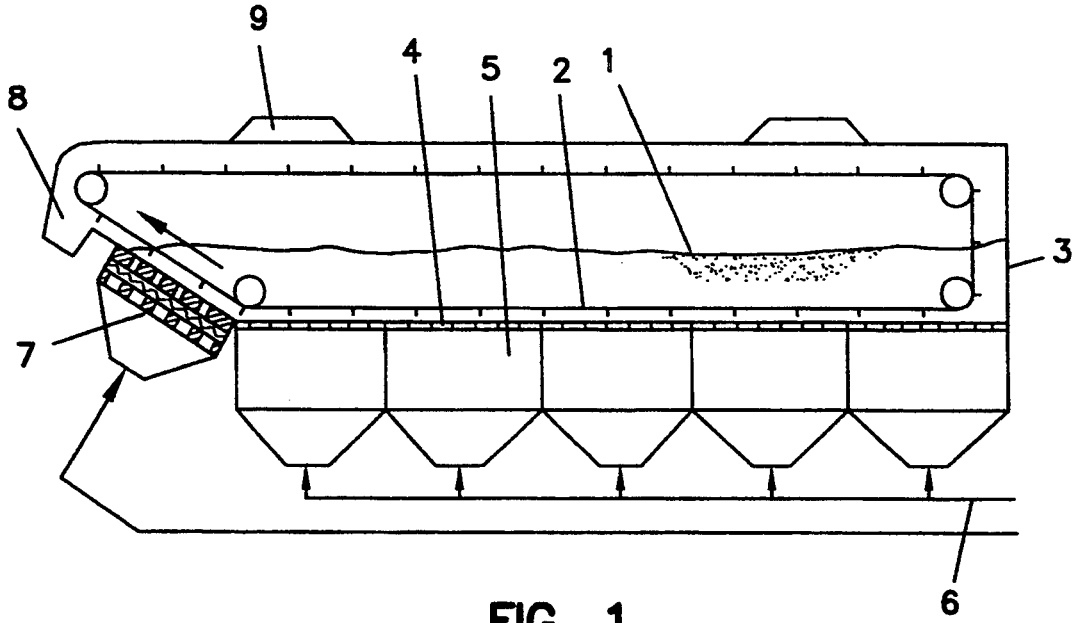

It can be seen from FIG. 1 that the compressed air passes through the pipeline 6, the air chamber 5 to the air distributor 4, where it is homogenized and enters the separation chamber 3 at a definite velocity and comes into contact with the heavy medium of the bed. When the velocity of the air reaches the starting velocity of the fluidization, the bed will expand to for a stable air-solid fluidized bed 1 with a definite density.

Figure 2:
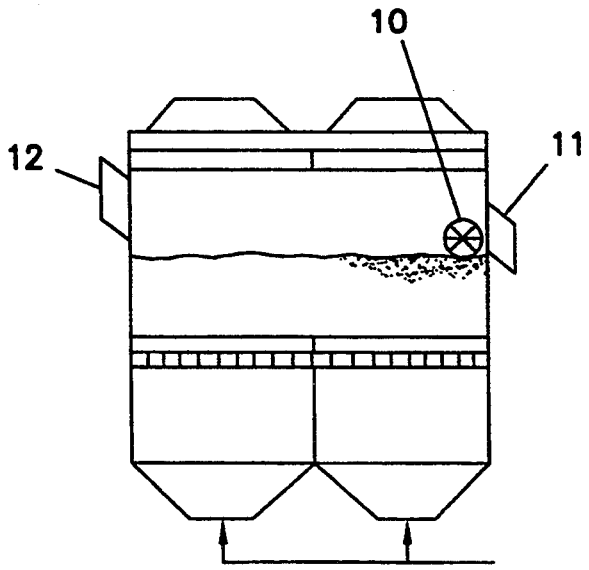
FIG. 2 is the diagrammatic right view of the structure of the preferred embodiment of the separation apparatus according to this invention.
Figure 3:
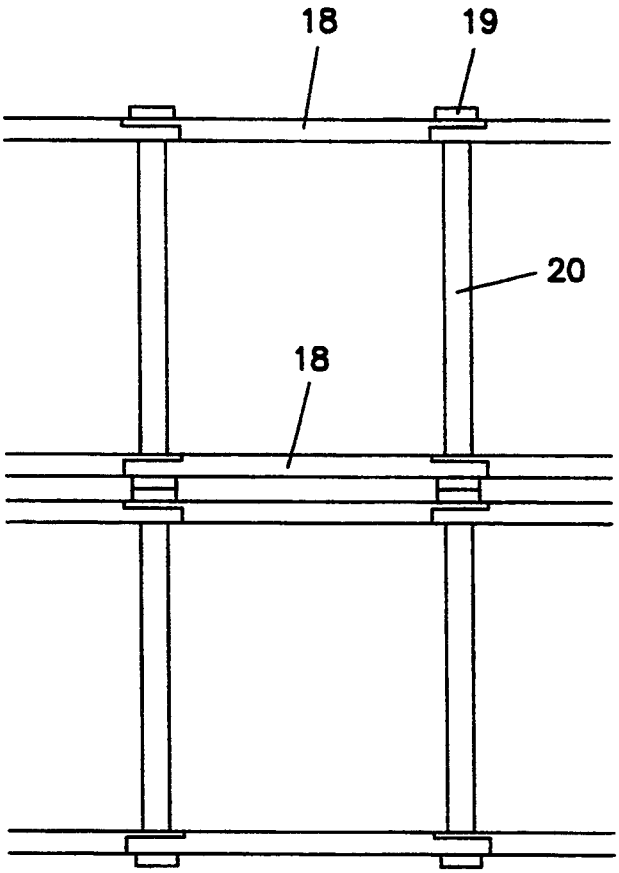
FIG. 3 is the diagrammatic view of the structure showing the connection between the chain-board and the scraper of the preferred embodiment according to this invention.
Figure 4:
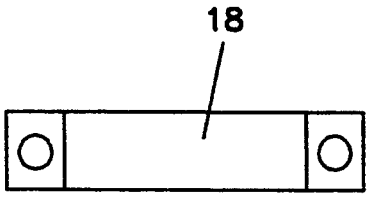
FIG. 4 is the diagrammatic view of the structure of chain-board of the preferred embodiment according to this invention.

It can be known from FIG. 2 and FIG. 1 that the raw coal and a small amount of supplementary heavy medium are fed from one side of separation chamber 3 to the bed 1 through the feed inlet 12. The raw coal is stratified according to its density in the fluidized bed, clean coal floats up and waste rock sinks down. The up floating materials move along the longitudinal direction of the separation chamber 3 and is taken to the discharge outlet 11 through the discharge wheel 10 and drained out therefrom. It is known from FIG. 1 that the waste rock depositing on the bottom of the bed and a part of heavy medium are scraped to the sink discharge outlet 8 and scraped out by the laterally disposed scraper conveyer 2. The air stream flowing through the fluidized bed and the dust are exhausted from the dedusting outlet 9. The upper part of the scraper conveyer 2 is exposed above the bed 1 and has no contact with the bed 1, the lower part of the scraper conveyer 2 is immersed at the bottom of the bed 1 and a clearance is kept with the air distributor 4 to ensure not to contact with each other so as not to damage the air distributor. From FIG. 3 and FIG. 4 it is known that the scraper conveyer 2 is structured with parallel double-scraper 20 and no reinforced rib is used. Two lapped chain boards 18 are fastened to scraper 20 with bolt 19. In order to reduce the discharged amount of the heavy medium along with the waste rock as little as possible while the later is scraped, an inner circulator 7 for heavy medium is provided between the air distributor 4 and the sink discharge outlet 8 under the scraper conveyer 2 to eliminate the formation of a dead region when the waste rock is scraped to this area. Meanwhile, the heavy medium can be separated from the waste rock through the fluidization and sent back to the fluidized bed 1 so that its discharge amount can be reduced.

Figure 5:
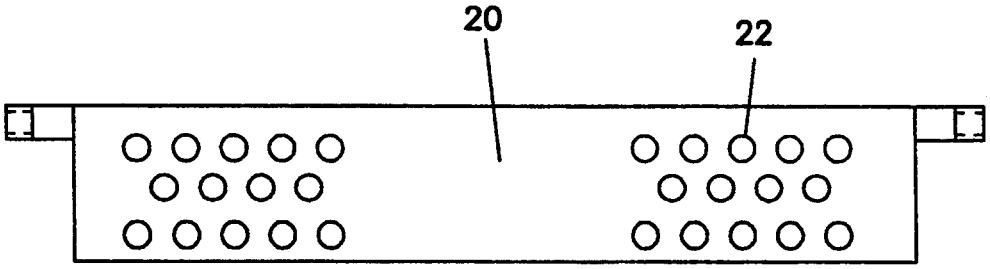
FIG. 5 is the diagrammatic view of the structure of scraper of the preferred embodiment according to the present invention.

It is known from FIG. 5 and FIG. 1 that in the scraper conveyer 2, a series of holes 22 of diameter 6 to 13 mm are defined on the scraper 20 equidistantly and in a staggering manner to reduce the resistance acting on the scraper 20 as much as possible when it moves along the bottom of the bed and to separate a part of heavy medium therefrom. Two chain-boards 18 and scraper 20 are fastened together with bolt 19 to prevent effectively the scraper 20 from sinking down and to keep a proper clearance between the scraper 20 and the air distributor 4.

Figure 6:
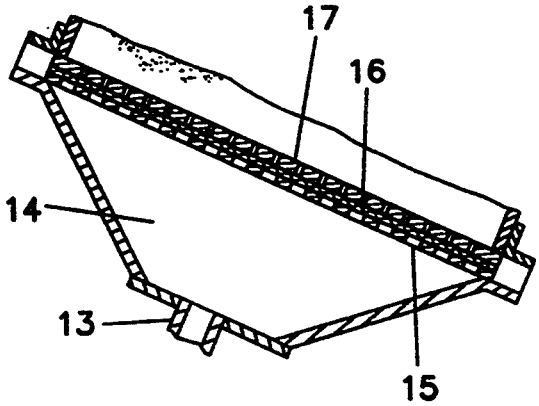
FIG. 6 is the diagrammatic view of the structure of the inner circulator for heavy medium according to the present invention.

It is known from FIG. 6 and FIG. 1 that the inner circulator 7 for heavy medium is provided at one side of the lateral waste rock discharge end with a definite inclination. It mainly consists of the air inlet tube 13, the air buffer chamber 14, the sieve layer 15, the multilayer fabric 16 and the sintered metal plate 17. The compressed air flows through the air inlet tube 13 and then enters the cone-shaped air buffer chamber 14. Decelerated and with pressure homogenized, it flows through the sieve layer 15, the multilayer fabric 16, the sintered metal plate 17, and enters the separation chamber 3. This part of air stream makes the waste rock and heavy medium depositing in the dead region fluidized evenly again. As a result, the resistance acting on the scraper 20 is reduced and a great part of fine heavy medium floats up and returns to the fluidized bed from sink waste rock, thus realizing the internal circulation of the heavy medium in the separation chamber 3, so that the long-term and stably continuous running is made possible.

This invention has many advantages such as wide separation region, high separation precision, high capacity, continuous and stable running. The capacity and separation precision are 9 times and 2 times respectively as high as that of prior art fluidized apparatus. The invention relates to a high capacity separator with advantages of high separation precision, low investment, low cost, water resources conservation, friendly to environment protection and it is easy to be spread for industrial applications.

It is claimed:

1. A high capacity dry separation apparatus with air-heavy medium fluidized bed, the apparatus comprising a separation chamber (3) with fluidized bed, an air distributor (4), an air chamber (5), a pipeline (6), a scraper conveyer (2) in the separation chamber (3), a sink discharge outlet (8) at one lateral side of the separation chamber (3), a dedusting outlet (9) at the top of the separation chamber (3), an up-floating materials discharge outlet (11) and a feed inlet (12), wherein:

(a): the feed inlet (12) and the up-floating materials outlet (11) are arranged on two opposite sides of the separation chamber (3) while a discharge wheel (10) is provided at the up-floating materials discharge outlet (11) in the separation chamber (3);

(b): the scraper conveyer (2) comprises two columns of scrapers moving side by side; the upper part of the scraper conveyer (2) is exposed above the fluidized bed (1) in the separation chamber (3) and the lower part is immersed at its bottom; the scraper conveyer (2) moves in a direction perpendicular to the moving direction of the up-floating materials;

(c): at one lateral side of the separation chamber (3), an inner circulator (7) for heavy medium is provided with a certain inclination, the inner circulator comprises an air inlet tube (13), a cone-shaped buffer chamber (14), a sieve layer (15), a multilayer fabric (16) and a sintered metal plate (17).

2. A high capacity dry separation apparatus with air-heavy medium fluidized bed according to claim 1, wherein the scraper conveyer (2) comprises lapped chain boards (18) and scrapers (20) which are fastened together with bolts (19).

3. A high capacity dry separation apparatus with air-heavy medium fluidized bed according to claim 1, wherein each column of the scraper conveyer (2) comprises a series of sets of chain boards (18) and scrapers (20), each set in one column is parallely arranged with respect to a corresponding set in the other column.

4. A high capacity dry separation apparatus with air-heavy medium fluidized bed according to claim 1, wherein every scraper (20) on the scraper conveyer (2) is formed with a series of holes (22) with certain diameters.

5. A high capacity dry separation apparatus with air-heavy medium fluidized bed according to claim 4, wherein the holes (22) defined on two ends of the scrapers (20) are provided with diameters of 6 mm to 13 mm, and are arranged equidistantly and in a staggered manner relative to one another.

6. A high capacity dry separation apparatus with air-heavy medium fluidized bed, the apparatus comprising a separation chamber (3) with fluidized bed, an air distributor (4), an air chamber (5), a pipeline (6), a scraper conveyer (2) in the separation chamber (3), a sink discharge outlet (8) at one lateral side of the separation chamber (3), a dedusting outlet (9) at the top of the separation chamber (3), an up-floating materials discharge outlet (11) and a feed inlet (12), wherein:

(a): the feed inlet (12) and the up-floating materials outlet (11) are arranged on two opposite sides of the separation chamber (3) while a discharge wheel (10) is provided at the up-floating materials discharge outlet (11) in the separation chamber (3);

(b): the scraper conveyer (2) comprises two parallel columns of scrapers moving side by side; each column of scrapers comprises a series of sets of lapped chain boards (18) and scrapers (20) fastened together with bolts (19); each scraper (20) is formed with a series of holes (22) therein having diameters of 6 mm to 13 mm and arranged equidistantly and in a staggered manner relative to one another; the upper part of the scraper conveyer (2) is exposed above the fluidized bed (1) in the separation chamber (3) and the lower part is immersed at its bottom; the scraper conveyer (2) moves in a direction perpendicular to the moving direction of the up-floating materials;

(c): at one lateral side of the separation chamber (3), an inner circulator (7) for heavy medium is provided with a certain inclination, the inner circulator comprises an air inlet tube (13), a cone-shaped buffer chamber (14), a sieve layer (15), a multilayer fabric (16) and a sintered metal plate (17).

* * * * *